US008256860B2

(12) United States Patent
Nakamura

(10) Patent No.: US 8,256,860 B2
(45) Date of Patent: Sep. 4, 2012

(54) PRINTING APPARATUS CAPABLE OF EFFECTIVELY HEATING AND COOLING INK

(75) Inventor: Hiroyuki Nakamura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 605 days.

(21) Appl. No.: 12/385,344

(22) Filed: Apr. 6, 2009

(65) Prior Publication Data

US 2009/0256870 A1 Oct. 15, 2009

(30) Foreign Application Priority Data

Apr. 14, 2008 (JP) ..... 2008-104885

(51) Int. Cl.
*B41J 29/38* (2006.01)

(52) U.S. Cl. ..... 347/14; 347/5; 347/6; 347/19

(58) Field of Classification Search ..... 347/14, 347/5, 6, 19
See application file for complete search history.

(56) References Cited

U.S. PATENT DOCUMENTS

| | | | | |
|---|---|---|---|---|
| 5,402,160 | A * | 3/1995 | Kadowaki et al. | 347/18 |
| 2001/0043244 | A1* | 11/2001 | Sakuma | 347/18 |
| 2003/0011665 | A1* | 1/2003 | Barinaga et al. | 347/85 |
| 2009/0015619 | A1* | 1/2009 | Chang et al. | 347/17 |

FOREIGN PATENT DOCUMENTS

| | | | |
|---|---|---|---|
| JP | 56-044664 | A | 4/1981 |
| JP | 07-060992 | A | 3/1995 |
| JP | 07-329317 | A | 12/1995 |
| JP | 11-170538 | A | 6/1999 |
| JP | 2004-276486 | | 10/2004 |
| JP | 2006-088575 | | 4/2006 |
| JP | 2008-037020 | A | 2/2008 |

OTHER PUBLICATIONS

Official Action, issued on May 29, 2012, in the counterpart Japanese application, three (3) pages.

* cited by examiner

*Primary Examiner* — Laura Martin
(74) *Attorney, Agent, or Firm* — The Nath Law Group; Jerald L. Meyer; Stanley N. Protigal

(57) ABSTRACT

A printing apparatus is provided with a heater for heating ink and a cooler for cooling ink, and comprises: an ink circulation route including a heater side route and a cooler side route which are separately provided through the heater and the cooler respectively; a switch mechanism operable to switch the ink circulation route between the heater side route and the cooler side route; and a control unit operable to control the switch mechanism. The control unit controls the switch mechanism to switch the ink circulation route to the heater side route when the ink temperature is lower than a first reference temperature, and switch the ink circulation route to the cooler side route when the ink temperature is no lower than the first reference temperature. By this configuration, the ink heating efficiency can be improved.

13 Claims, 7 Drawing Sheets

PRINTING APPARATUS CAPABLE OF EFFECTIVELY HEATING AND COOLING INK

BACKGROUND OF THE INVENTION

1. Field of the Invention

The present invention relates to an inkjet printing apparatus, and more particularly, relates to adjustment of the temperature of ink circulating the inkjet printing apparatus.

2. Description of the Background Art

Japanese Patent Published Application No. 2006-88575 discloses an ink jet printer in which ink is circulating. In the case of this type of ink jet printers, warranty temperature ranges are defined to ensure print quality for example as described in Japanese Patent Published Application No. 2004-276486.

Because of this, in this type of ink jet printers, it has been proposed to provide a heater for heating ink when the ink temperature has descended below the warranty temperature range and a cooler for cooling the ink when the ink temperature has risen above the warranty temperature range.

However, the heater and the cooler are devices for performing opposing operations. Because of this, the heating efficiency of the heater is often degraded by the provision of both the heater and the cooler. For example, while the cooler is provided with a heat sink and a fan, heat dissipation occurs from ink at the heat sink during heating the ink by the heater when the ink temperature is too low, so that the heating efficiency is degraded. Also, since the ink has to be passed through the heater and the cooler, the circulation route of the ink becomes long, so that the amount of ink increases in the circulation route. Because of this, it takes much time to heat the ink to an appropriate temperature by the heater.

SUMMARY OF THE INVENTION

Taking into consideration the above circumstances, it is an object of the present invention to provide a printing apparatus capable of heating ink with a heater and cooling ink with a cooler, in which the heating efficiency can be improved.

In order to accomplish the object as described above, the printing apparatus in accordance with the present invention is provided with a heater for heating ink and a cooler for cooling ink, and comprises: an ink circulation route including a heater side route and a cooler side route which are separately provided through the heater and the cooler respectively; a switch mechanism operable to switch the ink circulation route between the heater side route and the cooler side route; and a control unit operable to control the switch mechanism.

By this configuration, when heating ink, the ink is passed through the heater side route provided separately from the cooler, and therefore it is possible to inhibit heat dissipation and improve the efficiency of heating the ink. Because of this, the rate of raising the ink temperature is increased to shorten the time required for achieving an appropriate temperature. Accordingly, it is possible to shorten the time required to start the print process when the ambient temperature is low. Also, it is possible to shorten the time period during which the heater is turned on, and therefore to reduce the power consumption. Furthermore, it is possible to make use of a low power consumption heater as the heater for heating ink, and therefore to reduce the capacity required of the power supply.

In a specific embodiment, the printing apparatus further comprises: an ink thermometer operable to measure the temperature of the ink, wherein the control unit controls the switch mechanism to switch the ink circulation route to the heater side route when the ink temperature as measured is lower than a first reference temperature, and switch the ink circulation route to the cooler side route when the ink temperature as measured is no lower than the first reference temperature.

Also, since the ink temperature is influenced by the ambient temperature, the printing apparatus may further comprise: an ink thermometer operable to measure the temperature of the ink; and an ambient thermometer operable to measure the ambient temperature of the printing apparatus. In this case, the control unit controls the switch mechanism to switch the ink circulation route to the heater side route when the ink temperature as measured is lower than a first reference temperature, and switch the ink circulation route to the cooler side route when the ink temperature as measured is higher than a second reference temperature which is higher than the first reference temperature. Also, the control unit controls the switch mechanism to switch the ink circulation route to the heater side route when the ink temperature as measured is higher than the first reference temperature and lower than a second reference temperature and when the ambient temperature as measured is lower than the first reference temperature, and switch the ink circulation route to the cooler side route when the ambient temperature as measured is no lower than the first reference temperature.

Furthermore, if the print coverage is high, the ink temperature is expected to rise by the print process, and therefore the printing apparatus may further comprise: an ink thermometer operable to measure the temperature of the ink; an ambient thermometer operable to measure the ambient temperature of the printing apparatus; and a print coverage calculating unit operable to calculate the print coverage of an image to be printed. In this case, the control unit controls the switch mechanism to switch the ink circulation route to the heater side route when the ink temperature as measured is lower than a first reference temperature, and switch the ink circulation route to the cooler side route when the ink temperature as measured is higher than a second reference temperature which is higher than the first reference temperature. Also, when the ink temperature as measured is no lower than the first reference temperature and no higher than the second reference temperature and when the ambient temperature as measured is lower than the first reference temperature, the control unit controls the switch mechanism to switch the ink circulation route to the heater side route if the print coverage as measured is lower than a predetermined reference print coverage, and otherwise switch the ink circulation route to the cooler side route. Furthermore, when the ink temperature as measured is no lower than the first reference temperature and no higher than the second reference temperature and when the ambient temperature as measured is no lower than the first reference temperature, the control unit controls the switch mechanism to switch the ink circulation route to the cooler side route.

In any cases, the cooler may include a fan, and the control unit drives the fan when the ink temperature as measured is higher than a third reference temperature which is no lower than the first reference temperature and no higher than the second reference temperature. The control unit preferably drives the heater when the ink temperature as measured is lower than a third reference temperature which is no lower than the first reference temperature and no higher than the second reference temperature.

In the case where the printing apparatus is capable of printing images with a plurality of color inks, and a plurality of routes are provided for the color inks respectively as the ink circulation route, the switch mechanism may be capable of switching the ink circulation route for each color ink independently from the ink circulation routes for the other color inks, such that the control unit controls the switch mechanism for switching the ink circulation route for each color ink independently from the ink circulation routes for the other color inks.

Also, in the case where the printing apparatus is capable of printing images with a plurality of color inks, and a plurality of routes are provided for the color inks respectively as the ink circulation route, the switch mechanism may be operable only to uniformly switch the ink circulation routes for all the color inks. In this case, the control unit may control the switch mechanism for switching the ink circulation routes with reference to the highest or lowest temperature among the temperatures of the respective color inks. Alternatively, in such a case, the control unit may control the switch mechanism for switching the ink circulation routes with reference to the highest or lowest temperature among the temperatures of the respective color inks if there is a temperature, among the ink temperatures of the color inks, which is lower than the first reference temperature or higher than the second reference temperature, otherwise control the switch mechanism for switching the ink circulation routes with reference to the average value of the ink temperatures of the color inks.

The first reference temperature may be the lower limit of a warranty temperature range of ink defined to ensure print quality, and the second reference temperature may be the upper limit of the warranty temperature range. Also, in a preferred embodiment, the heater side route may have a shorter path length than the cooler side route. By this configuration, it is possible to reduce the amount of the circulating ink when the ink temperature is low, and therefore to further increase the rate of raising the ink temperature by the heater. Furthermore, in a preferred embodiment, the switch mechanism switches the ink circulation route only when the print process is not in progress for the purpose of preventing ink pressure variation due to switching of the switch mechanism from affecting the print process.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

In the following description, an embodiment of the present invention will be explained in conjunction with the accompanying drawings.

Figure 1:
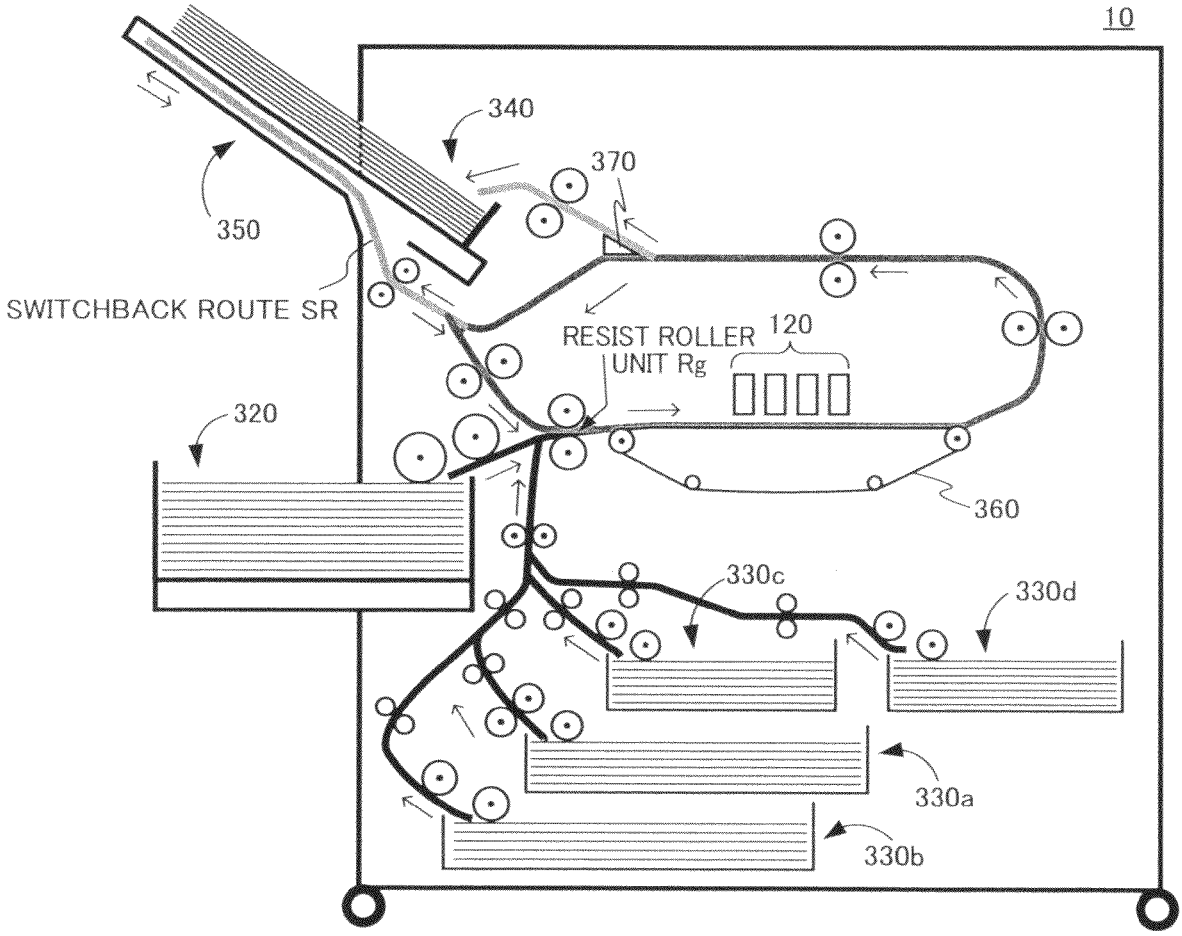
FIG. 1 is a schematic diagram for showing an ink jet printer in accordance with the present invention.

FIG. 1 is a schematic diagram for showing an ink jet printer 10 provided with a circulation transportation route in accordance with the present invention. Particularly, this figure shows the circulation transportation routes as print sheet circulation transportation routes. As shown in the same figure, the ink jet printer 10 is provided with a paper feed mechanism for feeding print sheets including a paper feed side tray 320 exposed from the side surface of the housing of the ink jet printer 10, a plurality of paper feed trays 330*a*, 330*b*, 330*c* and 330*d* which are located inside the housing. Furthermore, a discharge port 340 is provided as a discharge mechanism for discharging print sheets which have been printed.

The ink jet printer 10 is a line color inkjet printer, which is provided with a plurality of print heads each of which is provided with a number of nozzles formed to span the route in the direction perpendicular to the paper transportation direction, and serves as a print mechanism to eject black or color ink respectively in order to print images of the respective colors on a line-by-line basis. However, the present invention is not limited to a line inkjet printer, but also applicable to other types of printing apparatuses such as a serial color printer capable of forming images by scanning in the line direction.

The print sheets fed from either the paper feed side tray 320 or one of the paper feed trays 330 are transported one after another along a paper feed transportation route by a transportation mechanism such as roller units to a resist roller unit Rg. The resist roller unit Rg is composed of a pair of rollers and provided for defining a reference position at which the leading edge of each print sheet is aligned and oriented. The print sheet which is fed is stopped at the resist roller unit Rg for a short time, and then transferred in the direction toward the print mechanism with a predetermined timing.

The plurality of head units 120 are located on the transfer direction side of the resist roller unit Rg. The print sheet is printed to form an image with ink ejected from the print heads provided in the respective head units 120 on a line-by-line basis, while being transported at a predetermined speed in accordance with printer option settings on a conveyor endless belt 360 which is located on the opposite side to the head units 120.

The print sheet which has been printed is further transported in the housing by the transportation mechanism such as roller units. In the case of one-side printing for printing only one side of the print sheet, the print sheet is transferred directly to the discharge port 340 and stacked on a catch tray 350 provided as a receiver at the discharge port 340 with the printed side down. The catch tray 350 is provided to protrude from the housing with a certain thickness. The catch tray 350 is slanted with a lower upright wall at which print sheets discharged from the discharge port 340 are automatically aligned under their own weight.

In the case of double-side printing for printing both sides of the print sheet, the print sheet is not transferred to the discharge port 340 just after printing the main side (the first printed side is called "main side", and the next printed side is called "back side" in this description), but is transported again in the housing. Because of this, the ink jet printer 10 is provided with a shunt mechanism 370 for selectively switching the transfer route for printing on the back side. After printing on the main side, the shunt mechanism 370 transfers the print sheet which is not discharged to a switchback route SR such that the print sheet is reversed with respect to the transportation route by the switchback operation. The print sheet is transferred to the resist roller unit Rg again by the transportation mechanism such as roller units, and stopped at this resist roller unit Rg for a short time. Thereafter, the print sheet is transported to the print mechanism with a predetermined timing, and printed on the back side in the same manner as on the main side. After printing on the back side, the print sheet with images printed on the both sides is transferred to the discharge port 340, and stacked on the catch tray 350 serving as the receiver at the discharge port 340.

In the ink jet printer 10, the switchback operation is performed in the double-side printing mode by the use of the space formed in the lower portion of the catch tray 350. The space formed in the catch tray 350 is designed such that the print sheet cannot be accessed externally during the switchback operation. By this configuration, it is avoided that a user extracts the print sheet during the switchback operation by mistake. Incidentally, since the catch tray 350 is indispensable for the ink jet printer 10, there is no need for a separate space, which would be particularly provided in the ink jet printer 10 for the switchback operation, while making use of the space in the catch tray 350 for the switchback operation. Accordingly, it is possible to prevent the size of the housing from increasing for the purpose of implementing the switchback operation. Furthermore, since the discharge port and the switchback route are separated, the paper discharge operation can be performed in parallel with the switchback operation.

Figure 2:
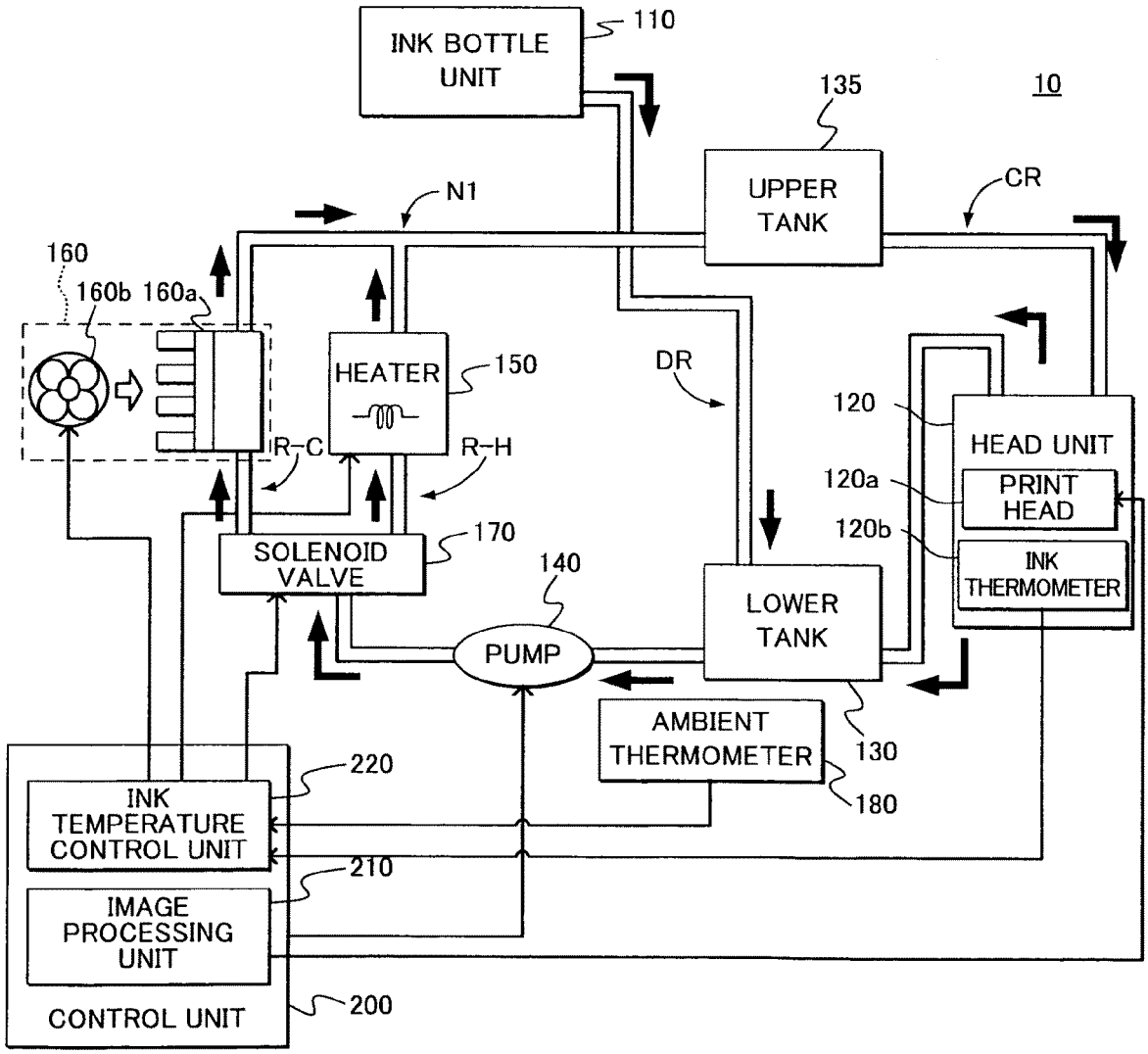
FIG. 2 is a block diagram for explaining the configuration of the ink flow routes in the ink jet printer in accordance with the present invention.

FIG. 2 is a block diagram for explaining the configuration of the ink flow routes in the ink jet printer 10 in accordance with the present invention. As shown in the same figure, the ink jet printer 10 is a printer which performs a print process with ink supplied from a detachable ink bottle unit 110, and provided with the head units 120, a lower tank 130, an upper tank 135, a pump 140, a heater 150, a cooler 160, a solenoid valve 170, an ambient thermometer 180, and a control unit 200.

In addition to this, the ink jet printer 10 is provided with a supply route DR which extends from the ink bottle unit 110 to the lower tank 130, and a circulation route CR which extends from the lower tank 130 and returns to the lower tank 130 through the pump 140, the upper tank 135 and the head units 120. These supply route DR and circulation route CR are formed by pipes made of a resin, a metal or the like, or a tube made of a resin or the like.

The ink supplied from the ink bottle unit 110 is passed through the supply route DR, and temporarily stored in the lower tank 130. Also, the circulation route CR is used to transfer the ink stored in the lower tank 130 through the upper tank 135, and then supplied to the head units 120 by the pump 140. The ink remaining in the head units 120 after the print process is returned to the lower tank 130. The water head difference between the upper tank 135 and the lower tank 130 is used to supply the head units 120 with ink from the upper tank 135 and return the remaining ink after the print process at the head units 120 to the lower tank 130. In the ink jet printer 10, as described above, ink is circulated through the circulation route CR during printing.

Also, between the lower tank 130 and the upper tank 135, there are the heater 150 for heating ink and the cooler 160 for cooling ink. The cooler 160 is provided with a heat sink 160*a* and a fan 160*b*. The fan 160*b* is provided in the vicinity of the heat sink 160*a* for the purpose of improving the cooling effect of the heat sink 160*a*.

In the case of the present embodiment, the circulation route CR includes separate routes in which the heater 150 and the cooler 160 are located respectively. Namely, the circulation route CR is branched into a heater side route R-H and a cooler side route R-C. The heater 150 is located in the middle of the heater side route R-H. The cooler 160 is located in the middle of the cooler side route R-C. These branch routes R-H and R-C meet at a junction point N1. The solenoid valve 170 is provided at the branching point in order to determine which route is used to flow the circulating ink by switching operation.

As has been discussed above, in the circulation route CR of the present embodiment, the heater side route R-H extending through the heater 150 and the cooler side route R-C extending through the cooler 160 are independently provided separated from each other in order to let ink flow only one of the branch routes R-H and R-C exclusively. By this configuration, it is possible to improve the ink heating efficiency when ink temperature is low. Also, by this configuration, the rate of raising the ink temperature is increased to shorten the time required for achieving an appropriate temperature. Accordingly, it is possible to shorten the time required to start the print process when the ambient temperature is low. Also, it is possible to shorten the time period during which the heater 150 is turned on, and therefore to reduce the power consumption. Furthermore, it is possible to make use of a low power consumption heater as the heater 150, and therefore to reduce the capacity required of the power supply.

Meanwhile, in order to further improve the ink heating efficiency, it is preferred that the heater side route R-H is shorter than the cooler side route R-C. By this configuration, it is possible to reduce the amount of the circulating ink when the ink temperature is low, and therefore to further increase the rate of raising the ink temperature by the heater 150.

Also, if the cooling mechanism and the heating mechanism are formed as a single unit, as in a conventional case, it is preferred to increase the contact area between the circulation route CR and the heat sink 160*a*. However, the efficiency of heating ink by the heat sink 160*a* is degraded due to the increased contact area of the heat sink 160*a*. Contrary to this, in the case of the present embodiment, since the heater side route R-H and the cooler side route R-C are independently provided separated from each other, the heater side route R-H is distant from the heat sink 160*a* and thereby it is possible to sufficiently increase the contact area between the circulation route CR and the heat sink 160*a* in the cooler side route R-C. It is therefore possible to improve not only the efficiency of heating ink but also the efficiency of cooling ink.

The head units 120 include print heads 120*a* which are provided with a number of nozzles which eject droplets of ink for printing. In the case of the present embodiment, it is assumed that each print head 120*a* ejects droplets of ink by the use of piezoelectric elements. The print heads 120*a* are provided with drivers (not shown in the figure) which control ink ejection from the respective nozzles by driving the piezoelectric elements on the basis of signals transmitted from the control unit 200, and ink thermometers 120*b* for directly or indirectly measuring the ink temperature.

The control unit 200 is a functional unit of the ink jet printer 10 serving to perform the print process, supply electric power and so forth. The hardware of the control unit 200 includes a CPU, a memory and the like. The control unit 200 of the present embodiment is provided with an image processing unit 210 which calculates the ink amount to be discharged for each dot (pixel) of an image to be printed and output the calculation results to the head units 120, and an ink temperature control unit 220 which controls the ink temperature. The ink temperature control unit 220 switches the solenoid valve 170 on the basis of the ink temperatures of the head units 120 as measured by the ink thermometers 120*b* and the ambient temperature of the ink jet printer 10 as measured by an ambient thermometer 180, and performs processes of managing and controlling the ink temperature by controlling the operations of the heater 150 and the fan 160*b* of the cooler 160.

Incidentally, needless to say, while only one color ink is illustrated in this figure, a plurality of color inks are used for printing color images, and the above ink routes are provided for each color ink. In this case, the solenoid valve 170 can be switched independently for each color ink, or uniformly for all the color inks. The differences therebetween will be described later. Also, it is preferred that the solenoid valve 170 is located in the downstream side of the lower tank 130 for the purpose of minimizing pressure change in the print heads 120*a* due to the variation of the ink pressure during switching the position of the solenoid valve 170.

First Example

Figure 3:
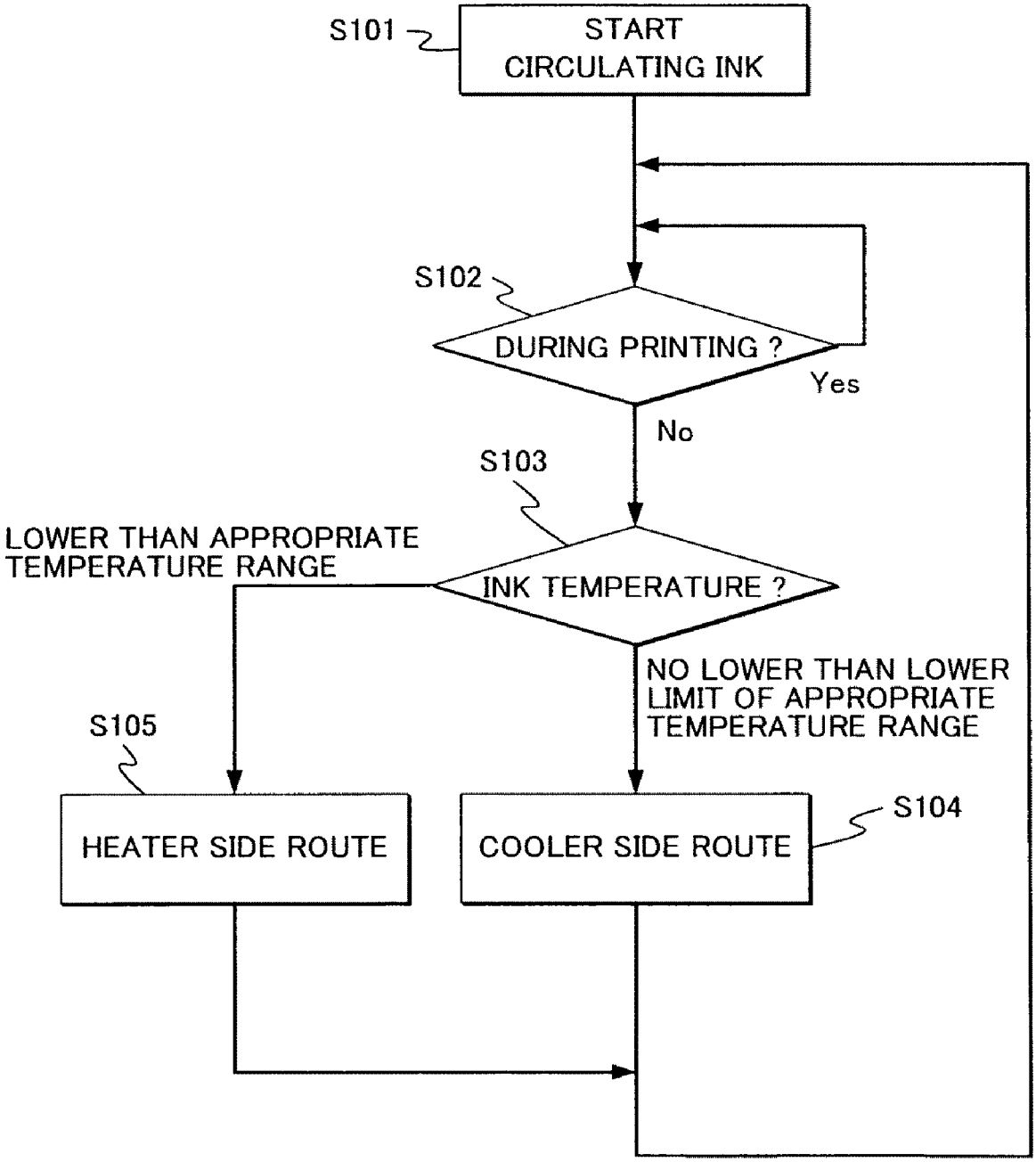
FIG. 3 is a flow chart for showing a first example of the process of switching the solenoid valve in accordance with the present invention.

Next is a description of a first example of controlling the ink temperature in the ink jet printer 10 having the aforementioned configuration. FIG. 3 is a flow chart for showing the process of switching the solenoid valve 170 by the ink temperature control unit 220 of the control unit 200 in accordance with this first example. A lower limit and an upper limit are determined in advance to define an appropriate temperature range or a warranty temperature range of ink. The control unit 200 performs the process of switching the solenoid valve 170 with reference to the ink temperature as measured by the ink thermometers 120*b* on the basis of the appropriate temperature range.

First, in advance of starting the print process, the pump 140 is driven to start circulation of ink in step S101. Switching the solenoid valve 170 is performed only when the print process is not in progress for the purpose of preventing ink pressure variation due to switching of the solenoid valve 170 from affecting the print process. Because of this, it is determined whether the print process is not in progress in step S102.

If it is confirmed that the print process is not in progress ("No" in step S102), the ink temperature as measured by the ink thermometers 120*b* is acquired, and it is determined whether the measured ink temperature is lower than the appropriate temperature range, or no lower than the lower limit of the appropriate temperature range in step S103. As a result, if the measured ink temperature is lower than the appropriate temperature range, the solenoid valve 170 is switched to the heater side route R-H in step S105, and if the measured ink temperature is higher than or equal to the lower limit of the appropriate temperature range, the solenoid valve 170 is switched to the cooler side route R-C in step S104. The lower limit of the appropriate temperature range is used as a reference temperature for switching the solenoid valve 170 because the ink temperature is expected to rise when starting the print process which heats the ink. However, a different temperature within the appropriate temperature range, for example, a center temperature thereof can be used in place of the lower limit of the appropriate temperature range.

Figure 4:
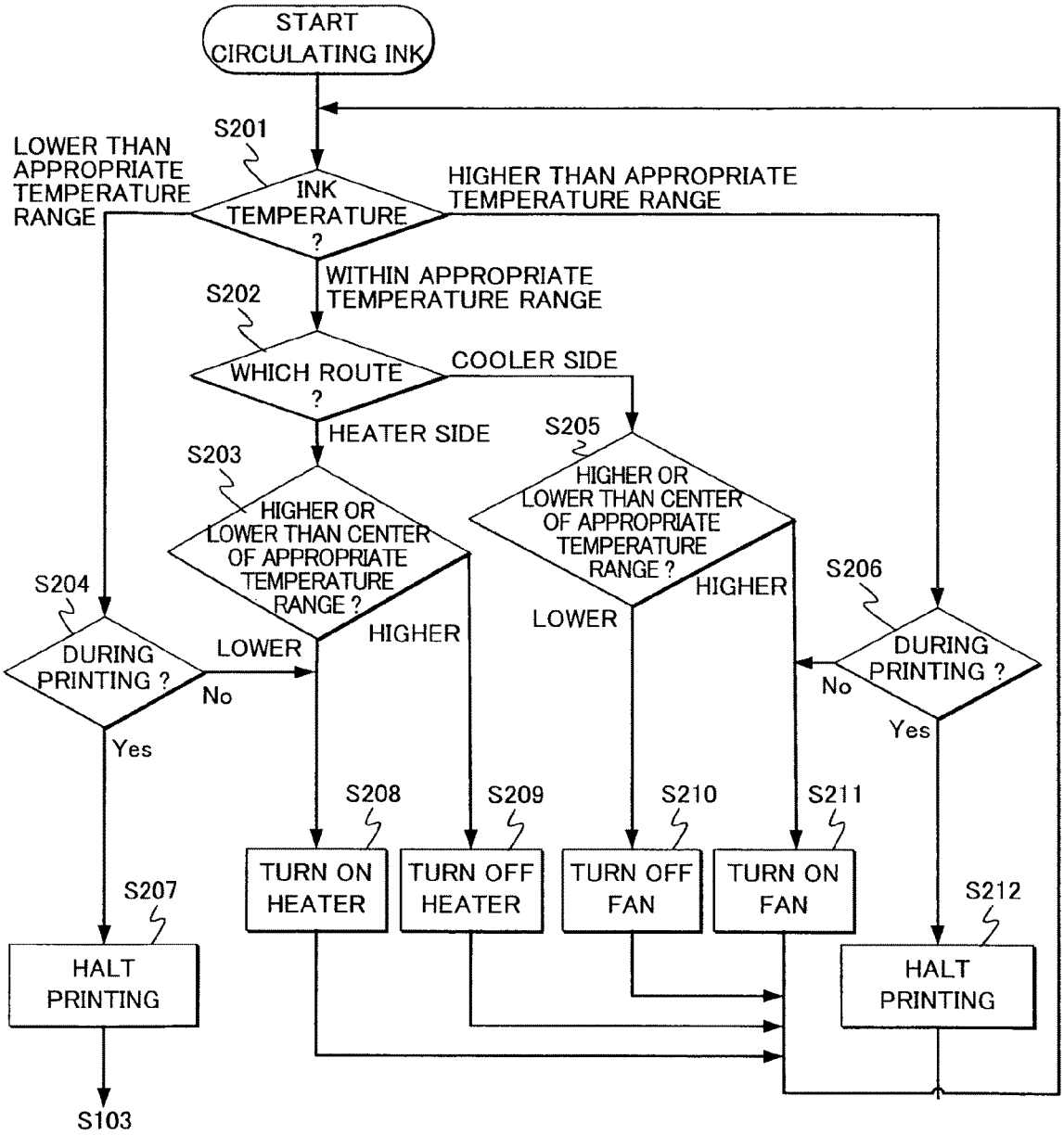
FIG. 4 is a flow chart for explaining the process of controlling the operation of the fan and cooler of the ink jet printer in accordance with the first example of the present invention.

Next, the flow chart of FIG. 4 is referred to explain the process of controlling the operation of the fan 160*b* of the cooler 160 and the operation of the heater 150 by the ink temperature control unit 220 of the control unit 200. In the case of the present invention, the ink temperature is controlled by switching the solenoid valve 170 to change the ink route as shown in FIG. 3 and also by controlling the fan 160*b* of the cooler 160 and the heater 150. The process shown in FIG. 4 is repeated more frequently than the process of switching the solenoid valve 170 to change the ink route as shown in FIG. 3, in order to control the ink temperature to hold within the appropriate temperature range.

After starting ink circulation, it is determined if the ink temperature is below, within or above the appropriate temperature range in step S201. As a result, if the ink temperature is below the appropriate temperature range, it is then determined whether or not the print process is in progress in step S204. When the print process is in progress (Yes in step S204), the ink temperature is too low to guarantee the print quality so that the print process is halted in step S207. Thereafter, the ink temperature as measured by the ink thermometers 120*b* is acquired in step S103.

When the print process is not in progress (No in step S204), ink is heated by turning on the heater 150 in step S208. In this case, since the solenoid valve 170 is switched to the heater side route R-H (refer to steps S103 and 105 of FIG. 3), ink is heated by the heater 150 which is turned on. Since the ink circulating the route is not passed through the cooler 160, heat dissipation is inhibited to effectively heat the ink. In addition, since the heater side route R-H is shorter than the cooler side route R-C, the amount of the circulating ink can be reduced when ink is passed through the heater side route R-H as compared to the case when ink is passed through the cooler side route R-C, and therefore it is possible to increase the rate of raising the ink temperature. Also, since the time period during which the heater 150 is turned on can be shortened, it is possible to reduce the power consumption. Furthermore, it is possible to make use of a low power consumption heater as the heater 150, and therefore to reduce the capacity required of the power supply.

When it is determined in step S201 that the ink temperature is higher than the appropriate temperature range, it is then determined whether or not the print process is in progress in step S206. When the print process is in progress (S206: Yes), the ink temperature is too high to guarantee the print quality so that the print process is halted in step S212. Thereafter, the ink temperature as measured by the ink thermometers 120*b* is acquired in step S103.

When the print process is not in progress (S206: No), ink is cooled by turning on the fan 160*b* of the cooler 160 in step S211. In this case, since the solenoid valve 170 is switched to the cooler side route R-C (refer to steps S103 and S104 of FIG. 3), ink is cooled by the heat sink 160*a* while the cooling efficiency is enhanced by the fan 160*b* which is turned on. Also, since the contact area between the circulation route CR and the heat sink 160*a* can be increased in the cooler side route R-C, it is possible to cool ink in a more effective manner.

When it is determined in step S201 that the ink temperature is within the appropriate temperature range, it is then determined in step S202 which of the cooler side route R-C and the heater side route R-H the solenoid valve 170 is switched to. As a result, if the solenoid valve 170 is switched to the heater side route R-H, it is determined in step S203 whether or not the ink temperature is higher than a predetermined reference temperature, for example, the center temperature of the appropriate temperature range. However, this reference temperature is not limited to the center temperature of the appropriate temperature range, but can be set to an appropriate temperature within the appropriate temperature.

Then, if the ink temperature is lower than the center temperature of the appropriate temperature range, the ink is heated in step S208 by turning on the heater 150 in order to prevent the ink temperature from falling below the appropriate temperature range, for example, due to a low ambient temperature. Conversely, if the ink temperature is higher than the center temperature of the appropriate temperature range, the ink need not be heated so that the heater 150 is turned off in step S209. At this time, the print coverage may be taken into consideration in controlling the ink temperature by calculating the print coverage of the print process. For example, if the print coverage is high, the ink temperature is expected to rise by the print process so that the reference temperature at which the heater 150 is turned on can be set to be higher.

On the other hand, in the case where the solenoid valve 170 is switched to the cooler side route R-C, it is determined in step S205 whether the ink temperature is higher or lower than a predetermined reference temperature, for example, the center temperature of the appropriate temperature range. This reference temperature is also not limited to the center temperature of the appropriate temperature range, but can be set to an appropriate temperature within the appropriate temperature.

Then, if the ink temperature is higher than the center temperature of the appropriate temperature range, the ink is cooled by turning on the fan 160*b* of the cooler 160 in step S211 in order to prevent the ink temperature from rising beyond the appropriate temperature range, for example, due to heat generated by the print process. Conversely, if the ink temperature is lower than the center temperature of the appropriate temperature range, the ink need not be cooled so that the fan 160*b* of the cooler 160 is turned off in step S210.

As has been discussed above, the ink temperature is controlled within the appropriate temperature range by switching the solenoid valve 170 to change the ink route in the steps as shown in FIG. 3 and also by controlling the fan 160*b* of the cooler 160 and the heater 150 in the steps as shown in FIG. 4, for example, such that when the measured ink temperature is higher than the lower limit of the appropriate temperature range in advance of starting the print process, the ink circulation route is switched to the cooler side route R-C by the process in step S104 branching from step S103, and after starting the print process the fan 160*b* is controlled to be turned on/off by repeating determination in step S201, step S202 and then step S205 in order to maintain the ink temperature within the appropriate temperature range.

Even if the ink temperature varies outside the appropriate temperature range during printing due to changes in temperature or the like, the print process is halted by the process in step S207 or step S212, followed by step S103 in which the ink circulation route is switched in accordance with the ink temperature such that the ink temperature can thereafter be adjusted by turning on the heater 150 in step S208 or turning on the fan 160*b* in step S211.

On the other hand, if the ink temperature is lower than the appropriate temperature range in advance of starting the print process, the ink circulation route is switched to the heater side route R-H by the process in step S105 branching from step S103, and the ink is then heated by turning on the heater 150 in step S201, step S204 and then step S208. When the ink temperature has risen to the appropriate temperature range by heating the ink with the heater 150, the print process is started. The heater 150 is then controlled to be turned on/off during printing by repeating determination in step S201, step S202 and then step S203 in order to maintain the ink temperature within the appropriate temperature range.

Incidentally, the reference temperatures to be used in steps S203, S205 and S103 can be determined on the basis of the performance of the heater 150, the performance of the cooler 160, the specific heat of ink and so forth. For example, in the case where the specific heat of ink is large, the thermal efficiency of the heater 150 becomes high such that it is relatively easy to raise the temperature. However, in this case, blowing air to the heat sink 160*a* by the fan 160*b* can not effectively be performed such that it is relatively slow to lower the temperature. In such a case, it is possible to more surely control the ink temperature within the appropriate temperature range by setting the reference temperature to a lower temperature than the center temperature of the appropriate temperature range.

Needless to say, the present invention is not limited to the processes as described above, but applicable to different processes, particularly in regard to the reference temperature used in step S103 and the flow chart shown in FIG. 4, as long as the ink temperature is controlled within the appropriate temperature range by measuring the ink temperature in advance of circulating the ink, controlling the heater and the fan and switching the ink circulation route when the print process is not in progress.

Second Example

Figure 5:
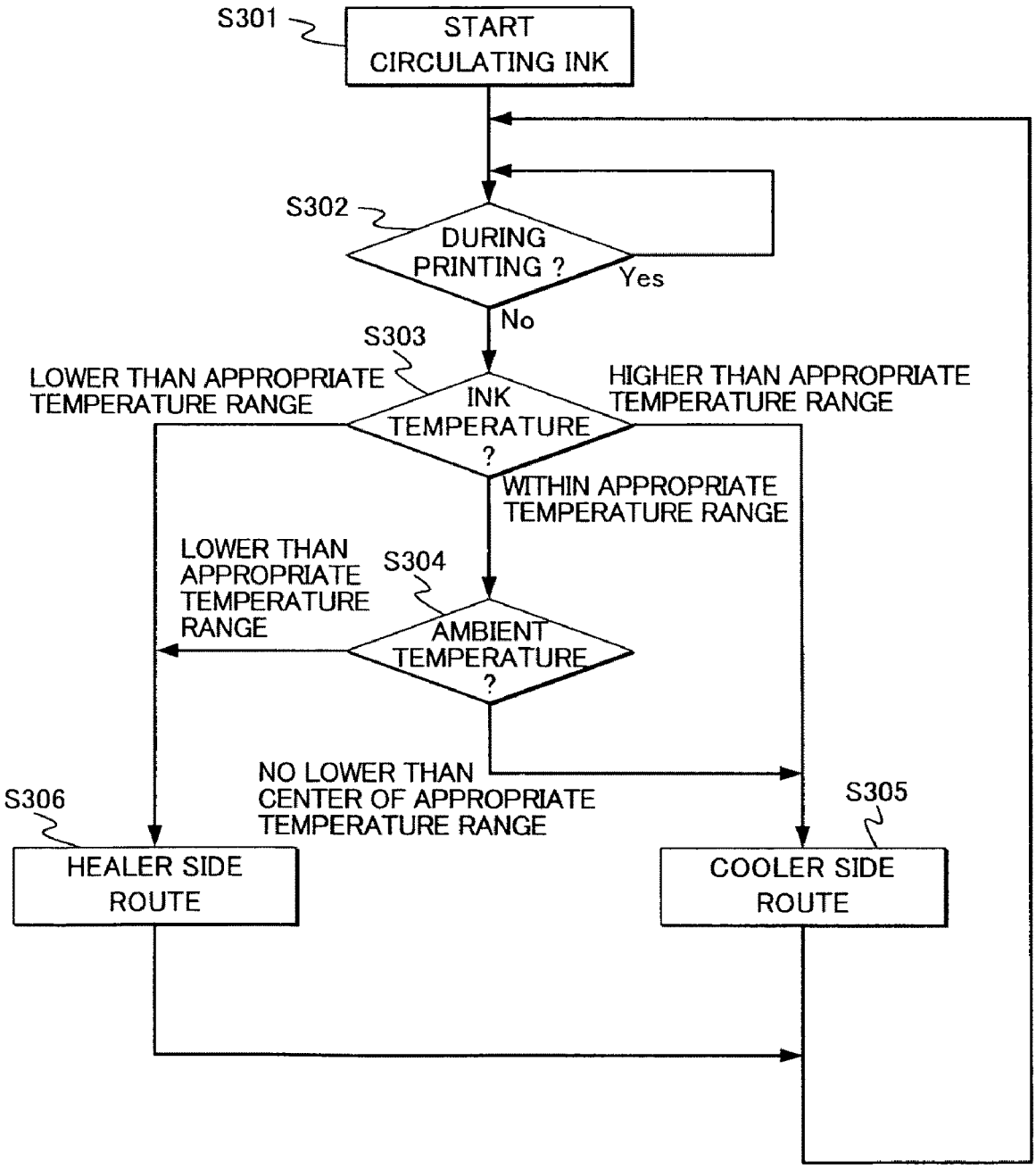
FIG. 5 is a flow chart for showing a second example of the process of switching the solenoid valve in accordance with the present invention.

Next is a description of a second example of controlling the ink temperature in the ink jet printer 10 having the aforementioned configuration. FIG. 5 is a flow chart for showing the process of switching the solenoid valve 170 by the ink temperature control unit 220 of the control unit 200 in accordance with this second example. In the case of the present example, the ambient temperature of the ink jet printer 10 is referred to and further taken into consideration for switching the solenoid valve 170. Namely, the ambient thermometer 180 provided for the ink jet printer 10 measures the ambient temperature inside or outside the ink jet printer 10. In the case of the second example, the ambient temperature is further taken into consideration because the temperature of the ink is influenced by the ambient temperature.

First, in advance of starting the print process, the pump 140 is driven to start the circulation of ink in step S301. Switching the solenoid valve 170 is performed only when the print process is not in progress for the purpose of preventing ink pressure variation due to switching of the solenoid valve 170 from affecting the print process. Because of this, it is determined whether the print process is not in progress in step S302.

If it is confirmed that the print process is not in progress ("No" in step S302), the ink temperature as measured by the ink thermometers 120*b* is acquired, and it is determined if the measured ink temperature is lower than, within or higher than the appropriate temperature range in step S303. As a result, if the measured ink temperature is lower than the appropriate temperature range, the solenoid valve 170 is switched to the heater side route R-H in step S306. Conversely, if the measured ink temperature is higher than the appropriate temperature range, the solenoid valve 170 is switched to the cooler side route R-C in step S305.

When it is determined in step S303 that the ink temperature is within the appropriate temperature range, it is then determined whether the ambient temperature measured by the ambient thermometer 180 is lower than the appropriate temperature range, or no lower than the lower limit of the appropriate temperature range in step S304. In the case of the present embodiment, the appropriate range of the ambient temperature is equal to the appropriate range of the ink temperature. However, depending upon the case, it may be effective to use different appropriate ranges for the ink temperature and the ambient temperature.

When it is determined in step S304 that the ambient temperature is lower than the appropriate temperature range, the solenoid valve 170 is switched to the heater side route R-H in step S306. This is because when the print coverage is successively low during the print process or when the print process is halted for a substantial time period, the ink temperature is influenced by the ambient temperature and may drop below the appropriate temperature range. On the other hand, when the ambient temperature is no lower than the lower limit of the appropriate temperature range, the ink temperature does not drop below the ambient temperature, i.e., below the appropriate temperature range so that the solenoid valve 170 is switched to the cooler side route R-C in step S305.

Incidentally, the operation of the heater 150 and the operation of the fan 160*b* of the cooler 160 are controlled in the same manner as in the first example.

Third Example

Figure 6:
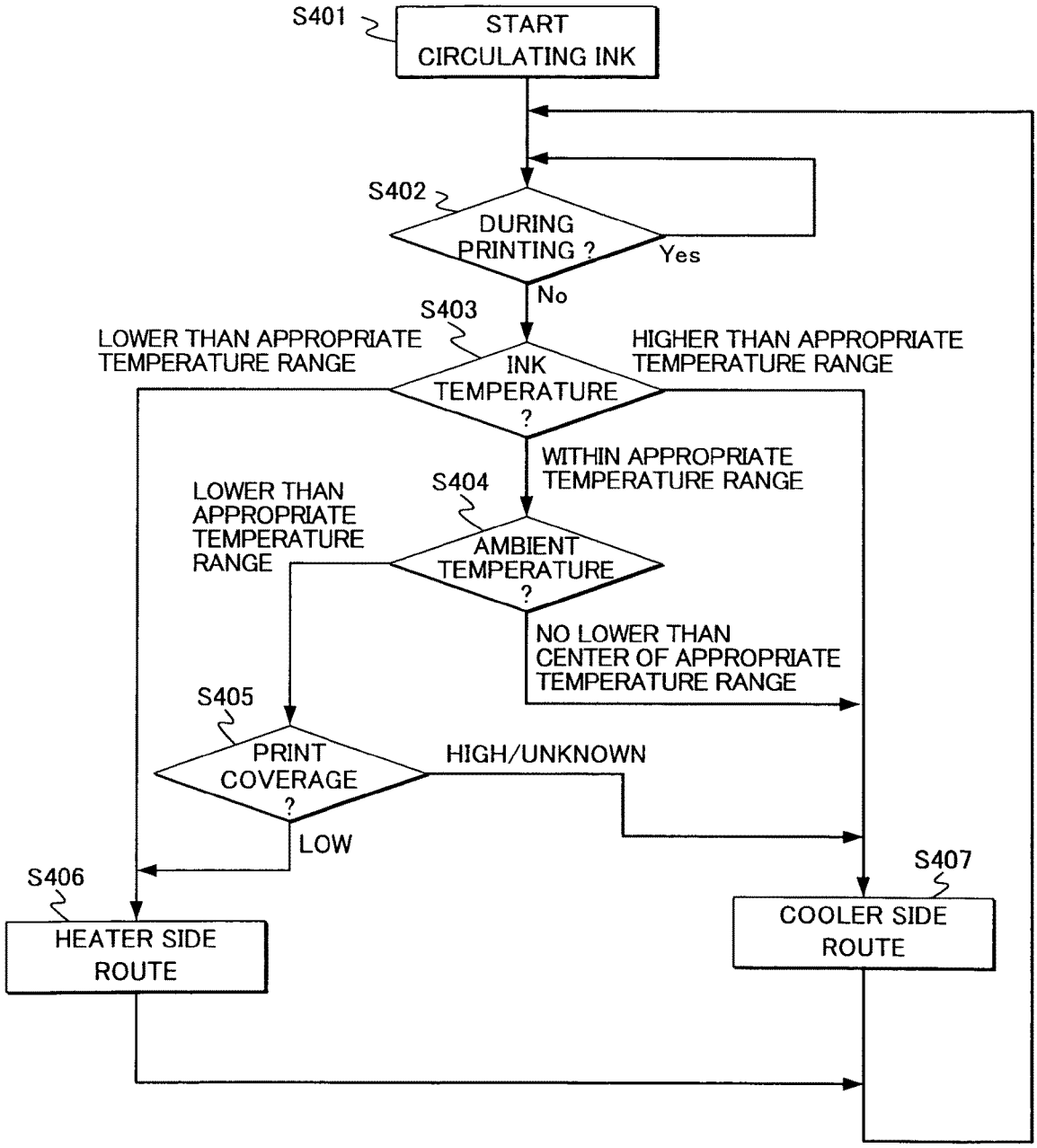
FIG. 6 is a flow chart for showing a third example of the process of switching the solenoid valve in accordance with the present invention.

Next is a description of a third example of controlling the ink temperature in the ink jet printer 10 having the aforementioned configuration. FIG. 6 is a flow chart for showing the process of switching the solenoid valve 170 by the ink temperature control unit 220 of the control unit 200 in accordance with this third example. In the case of the present example, the print coverage of images to be printed is referred to and further taken into consideration for switching the solenoid valve 170. Namely, the ink temperature tends to rise during the print process due to heat generated from the print driving mechanism, heat generated from ink oscillation or the like. The influence of the print process upon the ink temperature elevation is generally proportional to the print coverage. In other words, the higher the print coverage is, the faster the ink temperature rises. Conversely, the lower the print coverage is, the lesser the ink temperature is influenced. Because of this, in the case of the third example, the print coverage is further taken into consideration for switching the solenoid valve 170.

The print coverage can be obtained, for example, by calculating the proportion of the print area in relation to the printable area of the print sheet for each page to be printed by the image processing unit 210 of the control unit 200. Alternatively, the print coverage can be obtained on the basis of the number of dots or ink droplets to be ejected to the print sheet for each page.

First, in advance of starting the print process, the pump 140 is driven to start circulation of ink in step S401. Switching the solenoid valve 170 is performed only when the print process is not in progress for the purpose of preventing ink pressure variation due to switching of the solenoid valve 170 from affecting the print process. Because of this, it is determined whether the print process is not in progress in step S402.

If it is confirmed that the print process is not in progress ("No" in step S402), the ink temperature as measured by the ink thermometers 120*b* is acquired, and it is determined if the ink temperature is below, within or above the appropriate temperature range in step S403. As a result, if the measured ink temperature is lower than the appropriate temperature range, the solenoid valve 170 is switched to the heater side route R-H in step S406. Conversely, if the measured ink temperature is higher than the appropriate temperature range, the solenoid valve 170 is switched to the cooler side route R-C in step S407.

When the ink temperature is within the appropriate temperature range, it is then determined whether the ambient temperature measured by the ambient thermometer 180 is lower than the appropriate temperature range, or no lower than the lower limit of the appropriate temperature range in step S404. As a result, if the measured ink temperature is higher than or equal to the lower limit of the appropriate temperature range, the ink temperature does not drop below the ambient temperature, i.e., below the appropriate temperature range so that the solenoid valve 170 is switched to the cooler side route R-C in step S407.

When it is determined in step S404 that the ambient temperature is lower than the appropriate temperature range, the print coverage of the page to be next printed is calculated, followed by determining whether this print coverage is higher or lower than a predetermined reference value in step S405. As a result, if the print coverage is lower than the predetermined reference value, the print process is not expected to raise the ink temperature so that the solenoid valve 170 is switched to the heater side route R-H in step S406. On the other hand, if the print coverage is higher than the predetermined reference value, or if the print coverage of the page to be next printed is unknown, the solenoid valve 170 is switched to the cooler side route R-C in step S407.

Incidentally, the operation of the heater 150 and the operation of the fan 160*b* of the cooler 160 are controlled in the same manner as in the first example.

Other Examples

The above examples are illustrated with only one ink route for the sake of clarity in explanation. However, needless to say, there are a plurality of ink routes for the respective color inks in a color ink jet printer such that the solenoid valve 170 is provided for each color ink. The color ink jet printer can be designed such that the solenoid valve 170 can be switched only uniformly for all the color inks, or such that the solenoid valve 170 can be switched independently for the respective color inks.

Figure 7A:
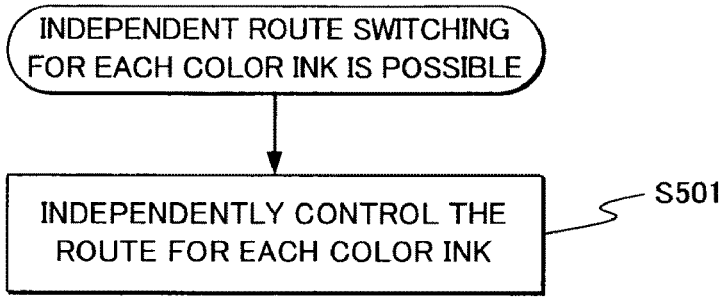
FIG. 7A is a flow chart for explaining the process of switching the solenoid valve in the case where the ink jet printer is designed such that the solenoid valve can be switched independently for the respective color inks.

In the case where the solenoid valve 170 can be switched independently for the respective color inks, the solenoid valve 170 is switched separately for each color ink in step S501 in accordance with the temperature of this each color ink independent from other color inks as shown in FIG. 7A. This is effective, for example, when monochromatic print processes are successively performed so that only black ink is heated to a higher temperature.

Figure 7B:
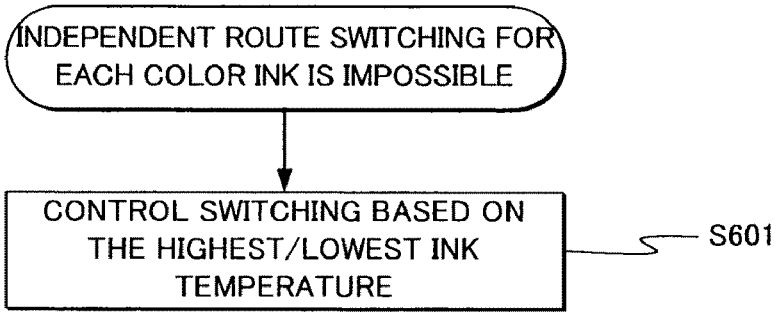
FIG. 7B is a flow chart for explaining the process of switching the solenoid valve in the case where the ink jet printer is designed such that the solenoid valve can be uniformly switched for all the color inks.

On the other hand, in the case where the solenoid valve 170 can be switched only uniformly for all the color inks, as shown in FIG. 7B the solenoid valve 170 is switched uniformly for all the color inks in step S601 in accordance with the highest or lowest temperature among the temperatures of the respective color inks. This is because it is possible to determine whether or not at least one of the ink temperatures varies outside the appropriate temperature range, only by referring to the highest and lowest temperatures.

Generally speaking, it is a very rare case that while the highest temperature rises beyond the appropriate temperature range, the lowest temperature drops below the appropriate temperature range. The highest temperature and the lowest temperature can therefore be used to determine how to switch the ink route, so that it is possible to employ a simple printer structure in which the solenoid valve 170 can be switched only uniformly for all the color inks.

Figure 7C:
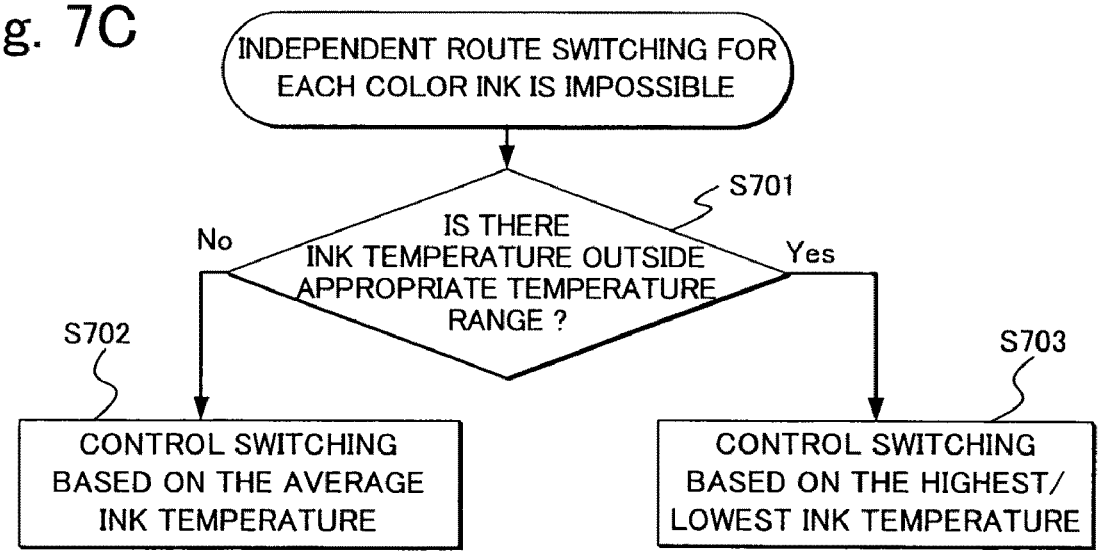
FIG. 7C is a flow chart for explaining another example of the process of switching the solenoid valve in the case where the ink jet printer is designed such that the solenoid valve can be uniformly switched for all the color inks.

For example, as shown in FIG. 7C, it is determined in step S701 whether or not there is an ink whose temperature is outside the appropriate temperature range among the respective color inks. If there is an ink whose temperature is outside the appropriate temperature range (Yes in step S701), the ink routes are changed in accordance with the highest temperature or the lowest temperature in step S703. Conversely, if the ink temperatures of all the color inks are within the appropriate temperature (No in step S701), the solenoid valve 170 is switched on the basis of the average value of these ink temperatures in step S702.

Alternatively, the color ink jet printer can be designed such that the solenoid valve 170 can be switched only uniformly for all the color inks, and such that the heater 160 is provided for each color ink and can be controlled independently from those for the other color inks. In this case, for example, when a particular color is intensively printed to raise only the ink temperature of this color such that the differential temperatures among the respective color inks substantially increase, the differential temperatures are decreased by independently driving the heater 160 for heating the color inks other than the color ink whose temperature is highest after switching all the ink routes to the heater side route R-H. After raising the temperatures of the other color inks close to the highest temperature, all the ink routes are switched to the cooler side route R-C followed by cooling the respective color inks to fall within the appropriate temperature range.

The foregoing description of the embodiments has been presented for purposes of illustration and description. It is not intended to be exhaustive or to limit the invention to the precise form described, and obviously many modifications and variations are possible in light of the above teaching. The embodiment was chosen in order to explain most clearly the principles of the invention and its practical application thereby to enable others in the art to utilize most effectively the invention in various embodiments and with various modifications as are suited to the particular use contemplated.

What is claimed is:

1. A printing apparatus provided with a heater for heating ink and a cooler for cooling ink, comprising:

an ink circulation route including a heater side route and a cooler side route which are separately provided through the heater and the cooler respectively;

a switch mechanism operable to switch the ink circulation route between the heater side route and the cooler side route;

a control unit operable to control the switch mechanism;

an ink thermometer operable to measure the temperature of the ink; and an ambient thermometer operable to measure the ambient temperature of the printing apparatus, wherein the control unit controls the switch mechanism to switch the ink circulation route to the heater side route when the ink temperature as measured is lower than a first reference temperature, and switch the ink circulation route to the cooler side route when the ink temperature as measured is higher than a second reference temperature which is higher than the first reference temperature, and wherein the control unit controls the switch mechanism to switch the ink circulation route to the heater side route when the ink temperature as measured is higher than the first reference temperature and lower than a second reference temperature and when the ambient temperature as measured is lower than the first reference temperature, and switch the ink circulation route to the cooler side route when the ambient temperature as measured is no lower than the first reference temperature.

2. The printing apparatus as claimed in claim 1 further comprising:

wherein the control unit controls the switch mechanism to switch the ink circulation route to the cooler side route when the ink temperature as measured is no lower than the first reference temperature.

3. The printing apparatus as claimed in claim 1 further comprising:

an ambient thermometer operable to measure the ambient temperature of the printing apparatus; and a print coverage calculating unit operable to calculate the print coverage of an image to be printed, wherein, when the ink temperature as measured is no lower than the first reference temperature and no higher than the second reference temperature and when the ambient temperature as measured is lower than the first reference temperature, the control unit controls the switch mechanism to switch the ink circulation route to the heater side route if the print coverage as measured, is lower than a predetermined reference print coverage, and otherwise switch the ink circulation route to the cooler side route, and wherein when the ink temperature as measured is no lower than the first reference temperature and no higher than the second reference temperature and when the ambient temperature as measured is no lower than the first reference temperature, the control unit controls the switch mechanism to switch the ink circulation route to the cooler side route.

4. The printing apparatus as claimed in claim 1 wherein the cooler includes a fan, and the control unit drives the fan when the ink temperature as measured is higher than a third reference temperature which is no lower than the first reference temperature and no higher than the second reference temperature.

5. The printing apparatus as claimed in claim 1 wherein the control unit drives the heater when the ink temperature as measured is lower than a third reference temperature which is no lower than the first reference temperature and no higher than the second reference temperature.

6. The printing apparatus as claimed in claim 1 wherein the printing apparatus is capable of printing images with a plurality of color inks, and a plurality of routes are provided for the color inks respectively as the ink circulation route, wherein the switch mechanism is capable of switching the ink circulation route for each color ink independently from the ink circulation routes for the other color inks, and wherein the control unit controls the switch mechanism for switching the ink circulation route for each color ink independently from the ink circulation routes for the other color inks.

7. The printing apparatus as claimed in claim 1 wherein the printing apparatus is capable of printing images with a plurality of color inks, and a plurality of routes are provided for the color inks respectively as the ink circulation route, wherein the switch mechanism is operable only to uniformly switch the ink circulation routes for all the color inks, and wherein the control unit controls the switch mechanism for switching the ink circulation routes with reference to the highest or lowest temperature among the temperatures of the respective color inks.

8. The printing apparatus as claimed in claim 1 wherein the printing apparatus is capable of printing images with a plurality of color inks, and a plurality of routes are provided for the color inks respectively as the ink circulation route, wherein the switch mechanism is operable only to uniformly switch the ink circulation routes for all the color inks, wherein the control unit controls the switch mechanism for switching the ink circulation routes with reference to the highest or lowest temperature among the temperatures of the respective color inks if there is a temperature, among the ink temperatures of the color inks, which is lower than the first reference temperature or higher than the second reference temperature, otherwise controls the switch mechanism for switching the ink circulation routes with reference to the average value of the ink temperatures of the color inks.

9. The printing apparatus as claimed in claim 1 wherein the first reference temperature is the lower limit of a warranty temperature range of ink defined to ensure print quality, and the second reference temperature is the upper limit of the warranty temperature range.

10. The printing apparatus as claimed in claim 1 wherein the heater side route has a shorter path length than the cooler side route.

11. The printing apparatus as claimed in claim 1 wherein the switch mechanism switches the ink circulation route only when the print process is not in progress.

12. A printing apparatus provided with a heater for heating ink and a cooler for cooling ink, comprising:

an ink circulation route including a heater side route and a cooler side route which are separately provided through the heater and the cooler respectively;

a switch mechanism operable to switch the ink circulation route between the heater side route and the cooler side route;

a control unit operable to control the switch mechanism; and an ink thermometer operable to measure the temperature of the ink, wherein the control unit controls the switch mechanism to switch the ink circulation route to the heater side route when the ink temperature as measured is lower than a first reference temperature, and switch the ink circulation route to the cooler side route when the ink temperature as measured is no lower than the first reference temperature, wherein the printing apparatus is capable of printing images with a plurality of color inks, and a plurality of routes are provided for the color inks respectively as the ink circulation route, wherein the switch mechanism is operable only to uniformly switch the ink circulation routes for all the color inks, wherein the control unit controls the switch mechanism for switching the ink circulation routes with reference to the highest or lowest temperature among the temperatures of the respective color inks if there is a temperature, among the ink temperatures of the color inks, which is lower than the first reference temperature or higher than the second reference temperature, otherwise controls the switch mechanism for switching the ink circulation routes with reference to the average value of the ink temperatures of the color inks.

13. A printing apparatus provided with a heater for heating ink and a cooler for cooling ink, comprising:

an ink circulation route including a heater side route and a cooler side route which are separately provided through the heater and the cooler respectively;

a switch mechanism operable to switch the ink circulation route between the heater side route and the cooler side route;

a control unit operable to control the switch mechanism; and an ink thermometer operable to measure the temperature of the ink, wherein the cooler includes a fan, wherein the control unit controls the switch mechanism to switch the ink circulation route to the heater side route when the ink temperature as measured is lower than a first reference temperature, and switch the ink circulation route to the cooler side route when the ink temperature as measured is no lower than the first reference temperature, wherein the control unit drives the fan when the ink temperature as measured is higher than an additional reference temperature which is no lower than the first reference temperature, and wherein the control unit drives the heater when the ink temperature as measured is lower than the additional reference temperature.

* * * * *